US007581474B2

(12) United States Patent
Weber

(10) Patent No.: US 7,581,474 B2
(45) Date of Patent: Sep. 1, 2009

(54) APPARATUS FOR SLICING AND ARRANGING FOOD PRODUCTS

(75) Inventor: Günther Weber, Groβ Nemerow (DE)

(73) Assignee: Weber Maschinenbau GmbH, Breidenbach (DE)

( * ) Notice: Subject to any disclaimer, the term of this patent is extended or adjusted under 35 U.S.C. 154(b) by 353 days.

(21) Appl. No.: 11/470,305

(22) Filed: Sep. 6, 2006

(65) Prior Publication Data

US 2007/0051217 A1 Mar. 8, 2007

(30) Foreign Application Priority Data

Sep. 8, 2005 (EP) ..... 05019560

(51) Int. Cl.
*B26D 7/06* (2006.01)

(52) U.S. Cl. ..... 83/29; 83/88; 83/76.9

(58) Field of Classification Search ..... 83/23, 83/29, 76.9, 84, 86, 97
See application file for complete search history.

(56) References Cited

U.S. PATENT DOCUMENTS 3,834,259 A 9/1974 Kuchler
4,196,646 A * 4/1980 Mukumoto ..... 83/88
4,379,416 A * 4/1983 Kuchler ..... 83/23
4,793,228 A * 12/1988 Etter et al. ..... 83/155.1
5,107,731 A * 4/1992 Kent ..... 83/91
5,251,142 A * 10/1993 Cramer ..... 700/171
5,727,433 A * 3/1998 Pomerleau et al. ..... 83/29
5,768,857 A * 6/1998 Ward et al. ..... 53/447
5,894,310 A * 4/1999 Arsenault et al. ..... 345/679
5,974,925 A * 11/1999 Lindee et al. ..... 83/412
6,318,224 B1 * 11/2001 Hoyland ..... 83/23
6,625,249 B1 * 9/2003 Temkin et al. ..... 378/4
6,640,681 B1 * 11/2003 Weber ..... 83/27
6,671,538 B1 * 12/2003 Ehnholm et al. ..... 600/425
6,722,267 B2 * 4/2004 Ciprietti et al. ..... 99/468
6,763,748 B2 * 7/2004 Wolcott et al. ..... 83/29
6,763,750 B2 * 7/2004 Lindee ..... 83/88
6,935,215 B2 * 8/2005 Lindee et al. ..... 83/74
7,450,247 B2 * 11/2008 Sandberg et al. ..... 356/601
2002/0092389 A1 * 7/2002 Feldman et al. ..... 83/49

(Continued)

FOREIGN PATENT DOCUMENTS

EP 0574649 12/1993

(Continued)

*Primary Examiner*—Kenneth E. Peterson
*Assistant Examiner*—Sean Michalski
(74) *Attorney, Agent, or Firm*—Gifford, Krass, Sprinkle, Anderson & Citkowski, P.C.

(57) ABSTRACT

An apparatus for slicing food products includes a product supply device that supplies a product to a cutting plane and a support table, onto which the product slices fall. The support table is provided with a controllable motor drive that displaces the support table relative to the falling product slices to form portions of any desired shape from a plurality of product slices. A formatting device includes a display device, on which product slices can be realistically presented. A user can prepare any desired formats from a plurality of product slices using a format function on the display device. An evaluation device converts the positions of the product slices into control commands for the motor drive, on the basis of which the motor drive displaces the support table based on the cutting speed to form portions on the support table that correspond to the format prepared on the display device.

17 Claims, 1 Drawing Sheet

U.S. PATENT DOCUMENTS

| | | | | |
|---|---|---|---|---|
| 2003/0145700 | A1* | 8/2003 | Lindee | 83/29 |
| 2003/0221528 | A1* | 12/2003 | Sandberg et al. | 83/412 |
| 2004/0016331 | A1* | 1/2004 | Wolcott et al. | 83/23 |
| 2004/0031363 | A1* | 2/2004 | Lindee et al. | 83/73 |
| 2005/0090915 | A1* | 4/2005 | Geiwitz | 700/90 |
| 2005/0177463 | A1* | 8/2005 | Crutchfield et al. | 705/27 |
| 2005/0246041 | A1* | 11/2005 | Kreifeldt et al. | 700/94 |
| 2006/0050988 | A1* | 3/2006 | Kraus et al. | 382/294 |
| 2006/0156878 | A1* | 7/2006 | Faires et al. | 83/13 |
| 2006/0189864 | A1* | 8/2006 | Paradis et al. | 600/407 |
| 2007/0012148 | A1* | 1/2007 | Workman et al. | 83/76.3 |
| 2008/0000337 | A1* | 1/2008 | Dickover et al. | 83/651 |
| 2008/0269596 | A1* | 10/2008 | Revie et al. | 600/424 |

FOREIGN PATENT DOCUMENTS

| | | |
|---|---|---|
| JP | 07285671 | 10/1995 |
| JP | 10118986 | 5/1998 |
| WO | WO00/59690 | 10/2000 |

* cited by examiner

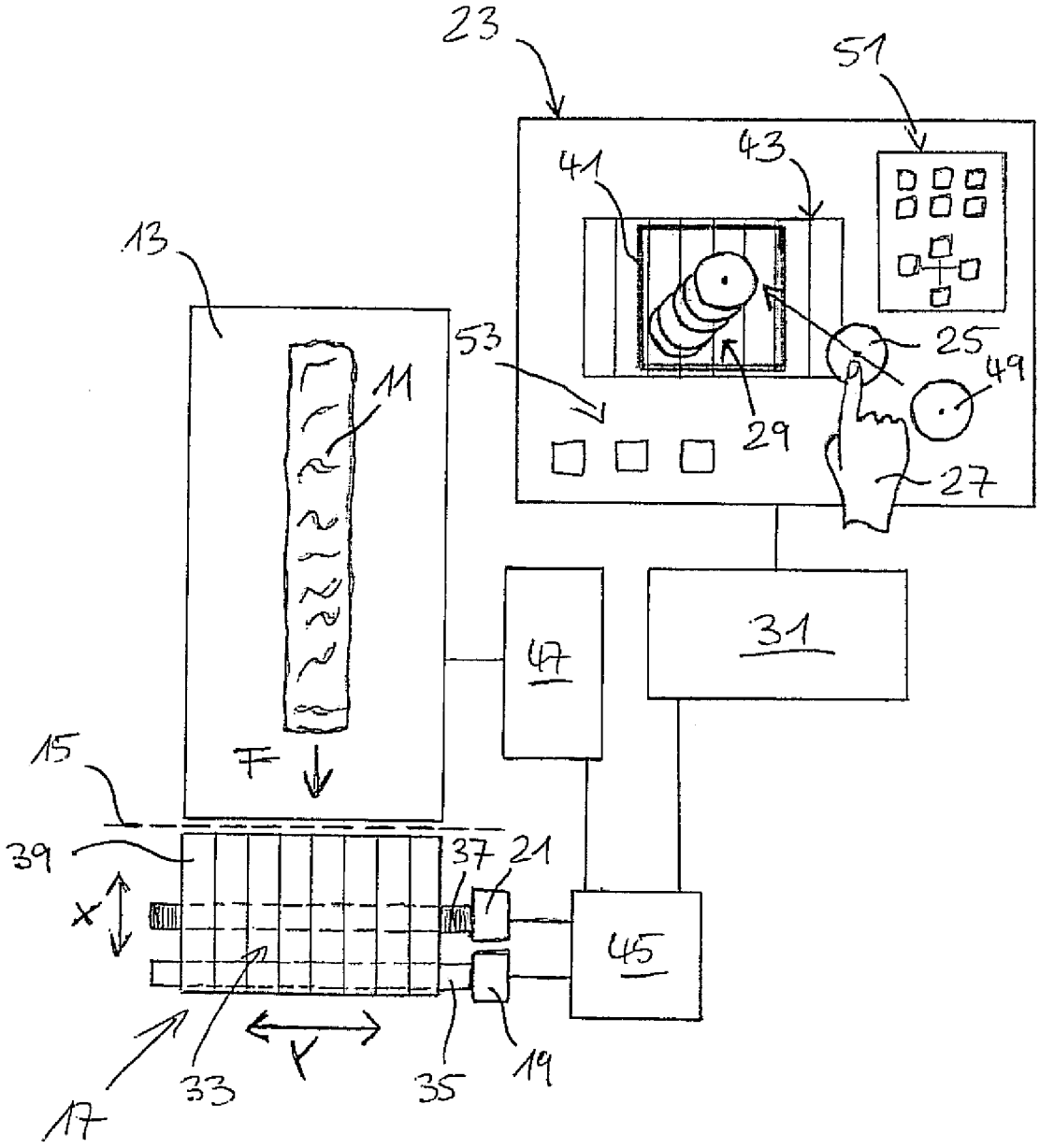
23
51
41
43
13
53
25
49
11
29
27
47
31
15
F
39
37
21
X
45
Y
17
33
35
19

APPARATUS FOR SLICING AND ARRANGING FOOD PRODUCTS

CROSS-REFERENCE TO RELATED APPLICATIONS

This application claims the benefit of European Patent Application No. 05 019 560.1, which was filed on Sep. 8, 2005, and the disclosure of which is incorporated herein by reference.

FIELD

The invention relates to an apparatus for the slicing of food products such as sausage, cheese, ham and the like comprising a product supply device which supplies a product to be sliced to a cutting plane in which a cutting knife moves, in particular in a revolving manner.

BACKGROUND

Food products of different consistency can be sliced in a high cutting sequence with such cutting apparatuses which are also termed slicers. The product slices produced in this process are supplied—combined in portions—with the help of conveying devices disposed downstream of the cuffing apparatus directly to a packaging machine which produces ready-to-sell portion packages. The presentation of sliced food products is becoming more and more important in sales. There is therefore an endeavor to form more and more complex arrangements of product slices by a sophisticated "portion design", and indeed already on slicing where possible so that the portions already having the desired "design" can be supplied directly to the packaging machine without the arrangement of the product slices having to be changed again.

Portioning bands arranged directly downstream of the cutting knives are already known which can be moved in order to form portions from product slices which fall onto the portioning band and whose shape differs from stacks of product slices disposed more or less precisely over one another. Overlapping portions can thus be produced, for example, in that the portioning band is moved relatively slowly in the conveying direction during the slicing process until the portion is complete and the portioning band accelerates to transport the portion away. Complex product geometries have previously not been able to be formed in practice in a simple manner since a corresponding programming of the movable portioning bands is extremely complex and can at best only be effected by trained specialists and only with a large effort of time.

SUMMARY

It is the object of the invention to provide a possibility which can also be used by technical laymen to form portions having any desired shape fast and simply from product slices produced using a cutting apparatus of the initially named kind.

In accordance with the invention, an illustrative tool which can be used intuitively for a portion design is also made available to the layman by the realistic presentation of product slices, wherein the user already has the result—that is the desired portion shape—literally "right in front of his eyes" before even one cut of the knife has been carried out. The format prepared, that is the "virtual" portion, is converted automatically in accordance with the invention into a corresponding control of the support table. No abstractly mathematical machine programming is required. The portion design can thereby be substantially accelerated and is practically not prone to error since an unwanted portion shape is already immediately recognized as such on the display device.

"Realistic" representation in no way absolutely represents a precise photorealistic copying of real product slices on the display device. Although this is admittedly possible in accordance with the invention, it is only important to select the representation so that the user can "simulate" the "real" situation on the support table in a manner as faithful to reality as possible on the display device.

It is preferred for this purpose for the product slices shown to correspond to the "real" product slices with respect to their shape, that is are circular when salami has to be sliced, for example. With respect to the size of the product slices shown, it is preferred for information to be made available to the user in a suitable manner on how much room a format he is just preparing will adopt on the "real" support table and at which position this format will lie on the support table. For this purpose, for example, a formatting region can additionally be presented on the display device which corresponds to a support region on the support table in which the formation of portions should take place. The formatting region can be stored on the screen, e.g. in particular with a photographic representation of the support table, such that the formatting region and the support region coincide at least approximately.

The motor drive for the support table can generally comprise any desired number of drive motors. Precisely one motor is preferably provided for each adjustment direction.

The display device is in particular a touch screen, also called a sensor screen, which can be operated particularly simply with a finger or a pen.

Within the framework of the formatting function in accordance with the invention, the preparation of the desired format preferably takes place by displacement of the product slices shown on the display device. A so-called drag and drop function can be provided for this purpose.

Provision is furthermore preferably made for the evaluation device to take account both of the location positions of the product slices on a support surface and of stack positions of the product slices inside stacks of product slices mutually overlapping at least in part in the calculation of the control commands. In addition to the positions in the support surface, "vertical positions" of the product slices defined by the sequence of placement can consequently also be taken into account. Formats can consequently be prepared so-to-say three-dimensionally on the display device and can likewise be reproduced three-dimensionally by a corresponding control of the support table.

Furthermore, a sorting function can be provided with which the stack positions of the product slices can be changed within an at least partly prepared format.

In addition, product slices can be aligned with respect to one another and/or relative to a predetermined direction or line in an at least partly prepared format by means of a preferably provided aligning function.

The positioning of the product slices in the preparation of a format, which in particular takes place by displacement, can be assisted by a grid which only allows specific positions which are disposed, for example, 1 mm apart (with respect to the "real" support table).

Furthermore, a fine positioning function—with respect to this comparatively coarse "free-hand" grid—can be provided with which product slices in an at least partly prepared format can be displaced in a predetermined fine grid of e.g. 1/10 mm.

Furthermore, a marking function can be provided with which one or more product slices can be selected in an at least partly prepared format to subsequently be the subject of a further function.

Further areas of applicability of the present disclosure will become apparent from the detailed description provided hereinafter. It should be understood that the detailed description and specific examples, while indicating the preferred embodiment of the present disclosure, are intended for purposes of illustration only and are not intended to limit the scope of the present disclosure.

BRIEF DESCRIPTION OF THE DRAWINGS

The present disclosure will become more fully understood from the detailed description and the accompanying drawings, wherein:

The only FIGURE shows a cutting apparatus with a formatting device in a schematic representation.

DETAILED DESCRIPTION

The following description of the preferred embodiment is merely exemplary in nature and is in no way intended to limit the present disclosure, its application, or uses.

The cutting apparatus comprises a product supply device 13, e.g. an endless conveyor belt, for food products 11 to be sliced which are supplied to a cutting plane 15 in which a cutting knife, not shown, revolves in a planetary manner, for example.

The product slices (not shown) cut off the product 11 by means of the cutting knife fall onto a support table in the form of a portioning band 17 which has a plurality of strip-shaped or belt-shaped endless bands 39 disposed next to one another which are guided by a front shaft 35 drivable by means of a motor 19 in both directions of rotation and by a rear, free-running shaft (not shown). This arrangement can in addition be moved in a transverse direction as a whole in the manner of a carriage via a spindle 37 which can likewise be driven in both directions of rotation by means of a motor 21.

The motor 19 thus permits a movement of the support surface 33 formed by the endless bands 39 and extending at least substantially horizontally—and thus of the product slices lying thereon—in and against the conveying direction F of the products 11, which will also be termed the x direction in the following, whereas the motor 21 permits a to and fro movement of the support surface 33 in a y direction (transverse direction) extending perpendicular to the x direction and parallel to the support surface 33.

Both motors 19, 21 can be controlled independently of one another by means of a motor control 45, with the speed and acceleration of the support surface 33 being able to be selected and changed practically continuously in both directions x, y. Both motors 19, 21 can in particular be operated simultaneously so that the support surface can be moved 33—so-to-say like a plotter—along practically any shape of horizontal track curves with any desired speed profiles or acceleration profiles. In figurative terms, any desired figures can thus be "drawn" on the support surface 33 using product slices.

The motor control 45 is a component of or communicates with a central machine control 47 which controls the operation of the cutting apparatus as a whole. Since the number of product slices which fall onto the support surface 33 per time unit is determined by the cutting performance also called the cutting speed, it is taken into account by the motor control 45 in the control of the motors 19, 21 for the movement of the support surface 33.

Control commands for the motor control 45 are generated by a computer-assisted evaluation device 31 on which a computer program for format formation has been implemented. In accordance with the invention, this format design program makes possible the realistic representation of product slices 25 and the realistic preparation of formats 29 which comprise a plurality of product slices 25 and which correspond to desired portion shapes on a display device 23 which is made e.g. as a touch screen.

As soon as a format 29 has been prepared, the control commands are calculated from the relative positions of the product slices 25 forming this format 29, said control commands being necessary to control the motors 19, 21 in dependence on the cutting performance such that the "real" product slices falling onto the portioning band 17 result in a portion which precisely corresponds to the previously prepared format 29.

The product slices 25 are matched with respect to their shape and size, in which they are presented on the touch screen 23, to the product 11 actually to be sliced and to its size ratio with respect to the support table 17. For this purpose, in addition to the presentation of a product slice store 49, a representation 43 of the support table is provided on the screen 23, with it being e.g. a photograph of the "real" support table 17 in a plan view which is used as the background image 43.

A support region on the "real" support table 17 in which the portion formation should take place, is shown on the screen 23 by a frame 41 superimposed on the representation 43 of the support table which is also termed a formatting region or a capturing region. In the preparation of formats 29, the product slices 25 can only be placed down with the condition that the centers of the product slices 25 are disposed inside the formatting region 41, with generally, however, other or additional conditions also being conceivable.

The preparation of formats 29 takes place in as simple a manner as conceivable which can also be learnt intuitively and fast by laymen in that the user 27 touches the product slice store 49 with a finger, drags a product slice 25 into the formatting region 41 (indicated by an arrow not shown on the monitor 23 and only serving for illustration here), places the product slice 25 at the desired position in the formatting region 41 and subsequently releases the product slice 25 (drag and drop function).

In this context, stack formations or overlapping designs are possible, as indicated in the FIGURE. The formats 29 are shown in the manner a corresponding portion would appear on the "real" support table 17—in a plan view. Alternatively, generally a perspective representation obliquely from above would also be possible, with the plan view, however, representing the preferred variant.

In addition, the coordinates of each product slice 25 in the format 29 can be presented on the screen 23, and indeed in particular as the x and y coordinates in a Cartesian coordinate system whose axes correspond to the displacement direction x and y of the support table 17 and whose center lies, for example, at the center of the formatting region 41. The coordinates relate to a characteristic point of the product slices 25, in particular at their center, i.e. a product slice 25 disposed precisely in the center of the formatting region 41 has the coordinates x=y=0.

The representation of these coordinates on the screen 25 allows the user an additional inspection of the format 29 and a precise correction of the positions of the product slices 25 forming the format 29. For this purpose, additional functions are made available by the format design program in accordance with the invention running on the computer 31 which the user can access by touching corresponding function symbols 51 on the screen 23.

These functions were already looked at in the introductory part. For the selection of a single product slice 25 which should be displaced e.g. in the format 29 relative to the other product slices 25 or which should be brought further upwardly or downwardly in the stack, it only has to be touched by a finger, whereupon e.g. its margin is shown in a different color to highlight the selected product slice 25. A plurality of product slices 25, which should e.g. be displaced together or should be aligned with respect to one another or horizontally or vertically, are selected in that first a marking symbol or multi-selection symbol is touched and subsequently the respective product slices 25 in the format 29 are selected or marked successively by touching. With a marked product slice 25 or with marked product slices 25, the desired processing function can then be selected by touching the corresponding function symbol 51.

Further function symbols 53 on the screen 23 in particular serve for the storage of prepared formats 29 or for the loading or importing of formats 29 already previously prepared.

A completed format 29 thus represents a set of coordinate pairs $(x_i, y_i)$, with each pair e.g. designating the position of the center of the respective product slice 25 with respect to the center of the formatting region 41. In addition, the format design program knows the stack positions of the individual product slices 25, i.e. the placing down sequence, which is necessary to be able to identically copy the format 29 shown.

The program calculates control commands for the motors 19, 21 of the support table 17 from the coordinates and stack position information and the motor control 45 coordinates the movement of the support table 17 in the x and y directions on the basis of them during the slicing of the corresponding product 11. The current cutting speed goes into the control of the motors 19, 21 by communication with the central machine control 47 so that the movement of the support table 17 can be matched to the "cycle" of the falling product slices.

Starting with the bottommost product slice 25 in the format stack 29 prepared "virtually" on the screen 23, the support table 17 moves sequentially to all positions of the product slices 25 forming the format stack 29 so that a slice just cut off the product 11 by means of the cutting knife falls precisely onto the position on the support surface 33 of the support table 33 which corresponds to the position of the corresponding "virtual" product slice 25 on the "virtual" support table 43 on the screen 23.

The format 29 which has been prepared on the screen 23 without any abstract-mathematical programming, solely by pictorial illustration, that is so-to-say by "graphical programming", is thus precisely reproduced by a movement of the support table 17 coordinated with the cutting speed, with the format design program running on the computer 31 translating the "image" 29 of the desired portion into a language which the motor control 45 can understand in order, in this manner, to make possible the programming of any desired support images, even extremely complex support images, at all or also for the lay person.

Generally, in accordance with the invention, the portion forming could be supplemented by vertical movements of the support table 17, that is by an adjustment of the support surface 33 in the z direction. The length of the falling distance for the product slices can thereby be varied so that additional placement effects could be achieved.

Furthermore, the formatting region 41 could be expanded, and indeed not only in the y direction, but also in the x direction. Provided that the design requirements for this are present, such formats 29 would e.g. also be conceivable for whose reproduction product slices already disposed on the support surface 33 have to be moved so far to the rear, i.e. against the conveying direction F, that they at least partly move behind the cutting plane 15. With relatively large product slices which adhere well to the support surface 33, this is possible comparatively easily since they can even hang down up to a certain amount temporarily from the support table 17.

The description of the present disclosure is merely exemplary in nature and, thus, variations that do not depart from the gist of the present disclosure are intended to be within the scope of the present disclosure. Such variations are not to be regarded as a departure from the spirit and scope of the present disclosure.

REFERENCE NUMBER LIST

11 food product
13 product supply device
15 cutting plane
17 support table, portioning band
19 motor for conveying direction
21 motor for transverse direction
23 displace device, touch screen, screen
25 product slice shown
27 hand of a user
29 prepared format
31 evaluation device, computer
33 support surface
35 shaft
37 spindle
39 endless conveyor belt
41 formatting region
43 representation of the support table
45 motor control
47 machine control
49 product slice store
51 function symbols
53 function symbols

What is claimed is:

1. An apparatus for slicing food products (11) such as sausage, cheese, ham and the like, comprising:

a product supply device (13), which supplies a product (11) to be sliced to a cutting plane (15) in which a cutting knife moves;

a support table (17) onto which the product slices cut off by means of the cutting plane fall, wherein the support table (17) is provided with a controllable motor drive (19, 21), which displaces the support table (17) relative to the falling product slices to form portions of any desired shape from a plurality of product slices; and a formatting device is provided with a display device (23) on which product slices (25) can be realistically presented and which has a formatting function by means of which a user (27) can prepare any desired formats (29) from a plurality of product slices (25) on the display device (23) by moving virtual product slices, wherein the formatting device additionally has an evaluation device (31) which converts the positions of the product slices (25) forming a prepared format (29) on the display device (23) into control commands for the motor drive (19, 21) on the basis of which the motor drive (19, 21) displaces the support table (17) in dependence on the cutting speed such that portions are formed on the support table (17) in accordance with the format (29) prepared on the display device (23).

2. An apparatus in accordance with claim 1, wherein the support table (17) has an at least substantially horizontal support surface (33) for the product slices and is displaceable in two directions (x, y) extending perpendicular to one another and parallel to the support surface (33), with a displacement direction (x) preferably extending in a conveying direction (F) of the products (11) and a displacement direction (y) extending transversely to the conveying direction (F).

3. An apparatus in accordance with claim 1, wherein the motor drive for each displacement direction (x, y) comprises precisely one actuating motor (35, 37).

4. An apparatus in accordance with claim 1, wherein the support table (17) is made as an endless conveyor with one or a plurality of endless conveyor bands (39) and a drive (19, 35) for the displacement movement for the formation of the portions of any desired shape is identical to the drive for the normal conveying operation for the transporting away of complete portions.

5. An apparatus in accordance with claim 1, wherein a spindle drive (21, 37) is provided for a displacement movement of the support table (17) transversely to the conveying direction (x), with the support table (17) being displaceable as a whole.

6. A formatting apparatus and a cutting apparatus, for the slicing of food products (11), wherein the cutting apparatus comprises a product supply device (13) which supplies a product (11) to be sliced to a cutting plane (15) in which a cutting knife moves and a support table (17), onto which the product slices cut off by means of the cutting knife fall and which is provided with a controllable motor drive (19, 21), which displaces the support table (17) relative to the falling product slices to form portions of any desired shape from a plurality of product slices;

wherein the formatting apparatus comprises:

a formatting device (23) on which product slices (25) can be realistically presented and which has a formatting function by means of which a user (27) can prepare any desired formats (29) from a plurality of product slices (25) on the display device (23) by moving virtual product slices; and an evaluation device (31), which converts the positions of the product slices (25) forming a prepared format (29) on the display device (23) into control commands for the motor drive (19, 21) on the basis of which the motor drive (19, 21) displaces the support table (17) in dependence on the cutting speed such that portions are formed on the support table (17) in accordance with the format (29) prepared on the display device (23).

7. A formatting apparatus in accordance with claim 6, wherein the product slices (25) shown are displaceable on the display device (23) using a drag and drop function.

8. A formatting apparatus in accordance with claim 6, wherein the display device (23) comprises a touch screen on which the product slices (25) shown are movable by touching with a finger of the user or using a working aid, in particular in pen form.

9. A formatting apparatus in accordance with claim 6, wherein a formatting region (41) can additionally be presented on the display device (23) and corresponds to a support region on the support table (17) in which the formation of portions should take place, with the formatting region (41) being stored with a representation (43) of the support table (17) such that the formatting region (41) and the support region coincide at least approximately.

10. A formatting apparatus in accordance with claim 6, wherein the evaluation device (31) takes account both of the location positions of the product slices (25) on a support surface and of stack positions of the product slices (25) inside stacks of product slices (25) mutually overlapping at least in part in the calculation of the control commands.

11. A formatting apparatus in accordance with claim 6, wherein coordinates of the product slices (25) forming the format (29) prepared can additionally be presented on the display device (23), with the coordinates each relating to a characteristic point of the product slices (25) and to a reference point on the support table (17).

12. A method of slicing food products (11) by means of a cutting apparatus, wherein a product (11) to be sliced is supplied to a cutting plane (15) in which a cutting knife is moved with the product slices cut off by means of the cutting knife falling onto a support table (17) which is provided with a controllable motor drive (19, 21) with which the support table (17) can be displaced relative to the falling product slices in order to form portions of any desired shape from a plurality of product slices, the method comprising:

providing a realistic representation of product slices (25) on a display device (23);

making available a formatting function by means of which a user (27) can prepare any desired formats (29) from a plurality of product slices (25) on the display device (23) by moving virtual product slices;

converting positions of the product slices (25) forming a prepared format (29) on the display device (23) into control commands for the motor drive (19, 21); and controlling the motor drive (19, 21) for the displacement of the support table (17) such that portions are formed on the support table (17) which correspond to the format (29) prepared on the display device (23).

13. A method in accordance with claim 12, wherein a drag and drop function, is made available with which the product slices (25) shown can be displaced on the display device (23).

14. A method in accordance with claim 12, wherein a formatting region (41) is additionally presented on the display device (23) and corresponds to a support region on the support table (17) in which the formation of portions should take place, with the formatting region (41) being stored with a representation (43) of the support table (17) such that the formatting region (41) and the support region coincide at least approximately.

15. A method in accordance with claim 12, wherein both location positions of the product slices (25) on a support surface and stack positions of the product slices (25) inside stacks of product slices (25) mutually overlapping at least in part are taken into account in the calculation of the control commands.

16. A method in accordance with claim 12, wherein coordinates of the product slices (25) forming the format (29) prepared are additionally presented on the display device (23), with the coordinates each relating to a characteristic point of the product slices (25) and to a reference point on the support table (17).

17. A method in accordance with claim 12, wherein at least one of selectable sorting, aligning, fine-positioning and marking functions are in particular additionally made available, in particular by touching the display device (23), with which, in an at least partly prepared format (29), the stack positions of product slices (25) can be changed (sorting), product slices (25) can be aligned with respect to one another and/or relative to a predetermined direction or line (aligning), can be displaced in steps corresponding to a predetermined fine grid (fine-positioning) and one or more product slices (25) can be selected (marking).

* * * * *